United States Patent [19]

Meyer et al.

[11] 4,209,940

[45] Jul. 1, 1980

[54] TOY EJECTOR APPARATUS

[75] Inventors: Burton C. Meyer, Downers Grove; Leonid Kripak, Villa Park; Fritz Fauser, Chicago, all of Ill.

[73] Assignee: Marvin Glass & Associates, Chicago, Ill.

[21] Appl. No.: 873,016

[22] Filed: Jan. 27, 1978

[51] Int. Cl.[2] ..... A63H 13/16

[52] U.S. Cl. ..... 46/145; 46/118; 46/1 R

[58] Field of Search ..... 46/116, 118, 175, 123, 46/145, 204, 1 R; 273/85 B, 101, 129, 96 R, 119 R

[56] References Cited

U.S. PATENT DOCUMENTS

| | | | |
|---|---|---|---|
| 2,154,297 | 4/1939 | Yancey | 46/204 X |
| 3,690,660 | 9/1972 | Olkowski | 273/101 |
| 3,751,849 | 8/1973 | Goldfarb et al. | 46/118 |
| 3,901,508 | 8/1975 | Spangler | 273/85 E |

FOREIGN PATENT DOCUMENTS

| | | | |
|---|---|---|---|
| 2322631 | 6/1977 | France | 273/101 |

*Primary Examiner*—Louis G. Mancene
*Assistant Examiner*—Mickey Yu
*Attorney, Agent, or Firm*—Mason, Kolehmainen, Rathburn & Wyss

[57] ABSTRACT

A novel toy apparatus includes a base having a pair of spaced apart, opposite, upstanding, hollow bodies open at the upper end for containing a projectile. An ejector tongue is provided in each body for propelling the projectile out of the open top of one body toward the open top of the opposite body. A manually rotated operator is provded for sequentially activating the ejector tongue in the respective bodies so that the projectile is propelled back and forth during play.

17 Claims, 5 Drawing Figures

TOY EJECTOR APPARATUS

BACKGROUND OF THE INVENTION 1. Field of the Invention

The present invention is directed towards a new and improved toy apparatus wherein a pair of upstanding hollow bodies are provided on a base, each having an ejector for propelling a ball or other projectile from one body toward the other as an operator is manually powered during play. The toy apparatus of the present invention also includes a sound generator associated with the operator to provide more lifelike sound animation during play.

2. Description of the Prior Art

A wide variety of toys have been developed wherein projectiles of one sort or another have been fired or propelled towards target means. Various types of target means have been developed and action type toys have often included different types of sound generating devices which make the play more realistic and entertaining. As far as is known, no toys have been developed wherein a pair of spaced apart, upstanding, hollow bodies are provided on a base, each having an ejector tongue for propelling a projectile or ball out of an open upper end towards an opposite hollow body as an operator is manually turned so that the projectile appears to be spit back and forth between the mouths of a pair of animated creatures resembling bullfrogs.

SUMMARY OF THE INVENTION

It is an object of the present invention to provide a new and improved toy apparatus of the character described.

More particularly, it is an object to provide a toy apparatus having a base with a pair of upstanding hollow bodies open at the upper end and each having ejector tongues therein for propelling a projectile such as a ball, out of the open top towards the open top of the opposite body as an operator is manually turned.

It is another object of the present invention to provide a new and improved toy apparatus of the character described which is fashioned to resemble a pair of bullfrogs and which during operation or play closely resembles a pair of frogs sitting opposite one another and spitting a ball back and forth into each others open mouth.

Another object of the present invention is to provide a new and improved toy apparatus of the character described which also includes a sound generating device activated by the operator to produce a frog-like croaking noise as the ball is projected back and forth between the frog-like hollow bodies.

Yet another object of the present invention is to provide a new and improved toy apparatus of the character described having novel ejector tongues which are secured to convex covers or heads having bulging eyes thereon and in combination with a hollow body representing the mouth of a frog opening and closing as the ejector is operated to propel a ball towards the opposite frog body.

Yet another object of the present invention is to provide a new and improved toy apparatus of the character described which is exciting and fun to play with and which requires and develops manual skill and dexterity during play.

The foregoing and other objects and advantages of the present invention are accomplished in a preferred embodiment by way of illustration and not limitation, which embodiment comprises a toy apparatus having a base with a pair of spaced apart, opposite, upstanding, hollow bodies open at the upper end for containing a projectile. An ejector tongue is provided in each of the bodies for propelling the projectile out of the open upper end of the body towards the open upper end of the opposite body. A rotary operator is included for activating the respective ejectors in each body in sequence in order to propel the projectile or ball back and forth between the bodies.

The bodies are designed to resemble the bodies of a pair of frogs sitting opposite one another and the ejectors are fashioned in the form of a frog tongue and depend from a convex cover or head having a pair of bulging eyes on the upper surface resembling the eyes of a large bullfrog. Each time the tongue and cover act to propel a ball toward the opposite frog's body, it resembles a frog opening his mouth to eject a ball towards the open mouth of an adjacent facing frog. The toy apparatus also includes a sound generating device actuated by the operator which develops a croaking sound similar to that of a bullfrog and the animated action resembles a pair of croaking frogs spitting a ball back and forth between each other.

BRIEF DESCRIPTION OF THE DRAWINGS

For a better understanding of the invention, reference should be had to the following detailed description taken in conjunction with the drawings, in which.

DESCRIPTION OF THE PREFERRED EMBODIMENT

Figure 1:
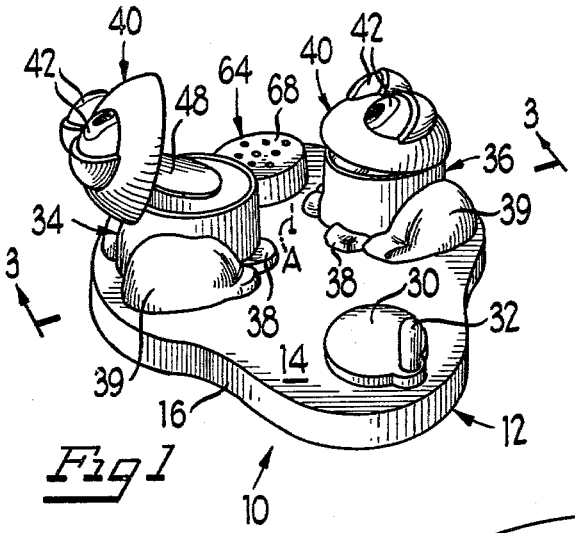
FIG. 1 is a perspective view of a toy apparatus constructed in accordance with the features of the present invention and shown in position ready for play.
Figure 3:
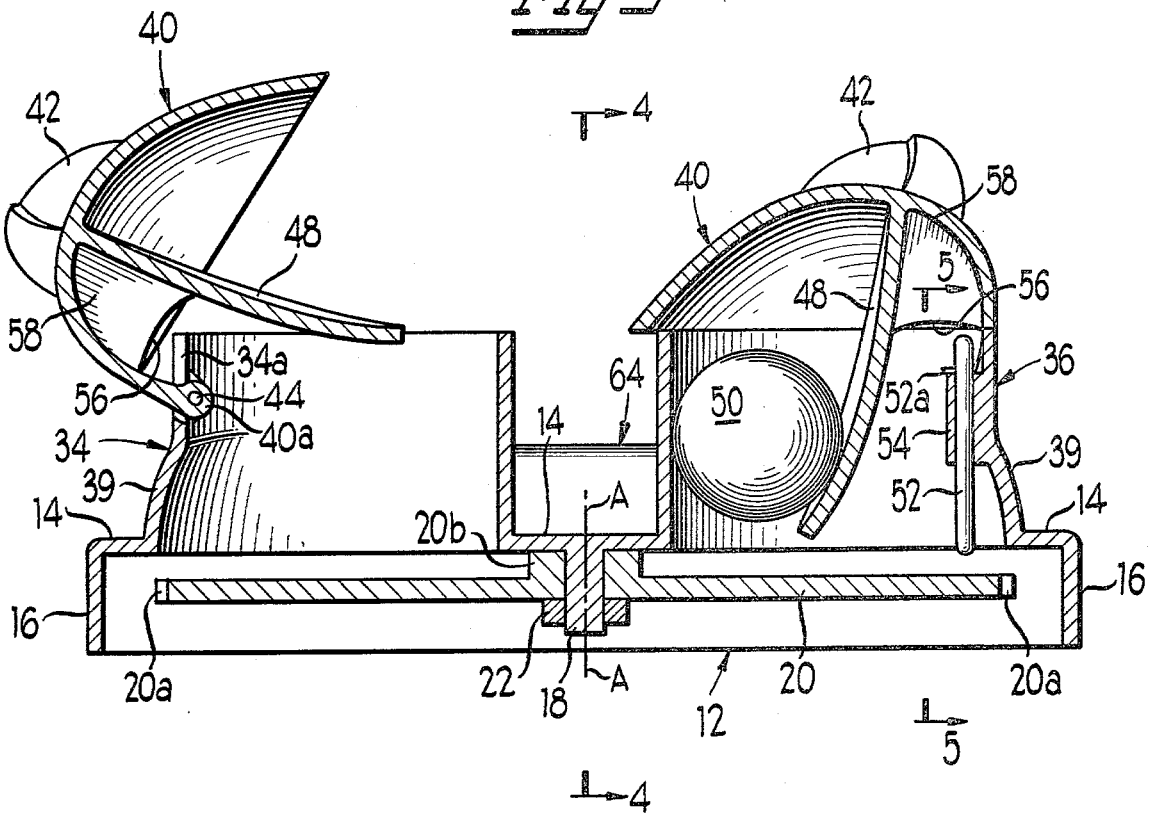
FIG. 3 is a transverse vertical cross-sectional view taken substantially along lines 3—3 of FIG. 1.
Figure 4:
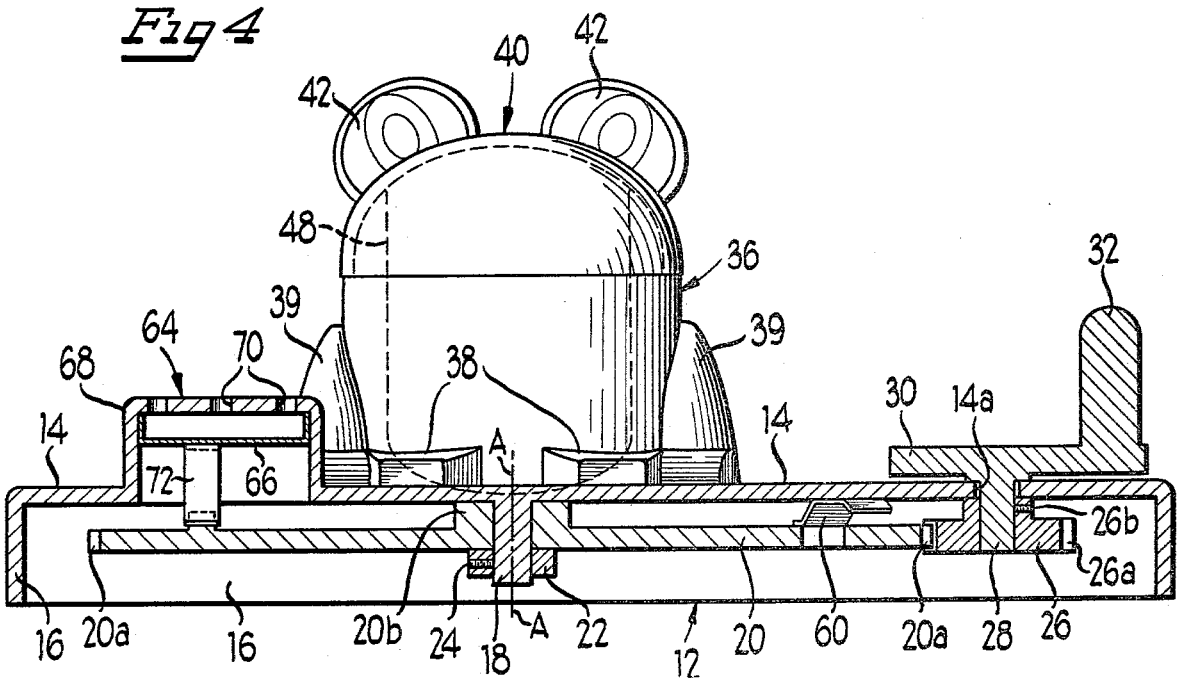
FIG. 4 is another transverse vertical cross-sectional view taken substantially along lines 4—4 of FIG. 3.

Referring now more particularly to the drawings, therein is illustrated a new and improved action toy constructed in accordance with the features of the present invention and referred to generally by the reference numeral 10. The toy apparatus includes a base structure 12 having an irregularly shaped flat or planar lower, horizontal surface 14 formed with a depending peripheral skirt 16 around the outer edge adapted to support the toy on the floor or other suitable playing surface as shown in FIG. 1. Preferably, the base structure is formed of integrally molded plastic material and at the center includes a downwardly depending pin 18, on which is journaled a circular operator or rotor disk 20 having gear teeth **20*a* formed around the outer circumference. The rotor includes a thickened central hub portion 20*b* adapted to provide a desired spaced apart relation between the upper surface of the rotor and the underside of the base wall 14 as best shown in FIGS. 3 and 4. An annular retaining collar 22 is provided on the lower end of the center pin 18 to hold the rotor in place and this collar may be secured in place on the pin by a set screw 24** as shown in FIG. 4.

The rotor disk 20 is freely rotatable about a vertical, center axis A—A (FIGS. 3 and 4) in coaxial alignment with depending support pin 18 and the rotor is driven by a spur gear 26 secured to the lower end of crank shaft 28 by a set screw 26*b*. The gear 26 includes teeth 26*a* which drivingly engage the teeth 20*a* on the larger rotor 20 to provide the desired amount of speed reduction. The gear shaft 28 extends downwardly through an aperture 14*a* formed in the base wall 14 at a point spaced radially outwardly of the center axis A—A. At the upper end, the shaft is integrally formed with a circular crank disk 30 having an upstanding eccentric crank handle 32 used for rotating the crankshaft. As indicated by the arrows in FIG. 2, when the crank disk 30 is rotated in a clockwise direction, the larger rotor 20 turns in a counterclockwise direction or vice versa and at a reduced speed dependent upon the ratio of diameters of the gear 26 and rotor.

In accordance with the present invention, the toy includes a pair of diametrically opposed, spaced apart, upstanding, hollow, cylindrical bodies 34 and 36 integrally formed on opposite sides of the center axis A—A in equilateral relation with respect to the location of the crankshaft 28. Preferably, the hollow bodies 34 and 36 are formed with irregularly shaped, integral feet portions 38 positioned to face each other and representing the front feet of a bullfrog or other frog-like amphibian creature. The bodies also include larger irregularly shaped enlargements 39 on opposite sides and outwardly of the feet 38, and these formations represent the large hind legs and feet of a frog.

Figure 5:
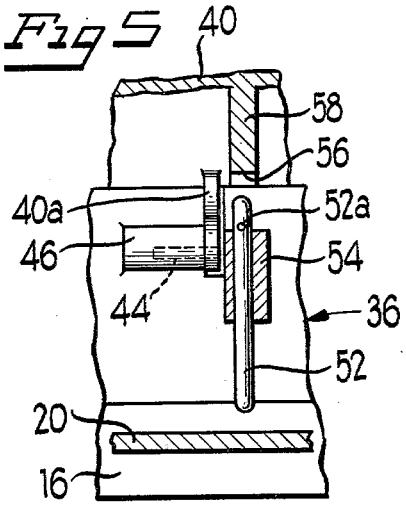
FIG. 5 is a fragmentary vertical cross-sectional view taken substantially along lines 5—5 of FIG. 3.

Each frog body is provided with a convex, substantially hemispherically shaped cover or head 40 and each head is formed with a pair of outwardly bulging frog eyes 42 on an outer upper surface portion thereof. The covers are mounted for pivotal movement on the respective hollow bodies 34 and 36 by means of depending tangs 40*a* integrally formed along a rearward edge to extend downwardly below the level of the upper open ends of the respective bodies (FIGS. 3 and 5). On the outside walls, the bodies are each formed with a vertical slot 34*a* and 36*a*, respectively, in order to accommodate a depending tang which is supported on horizontal axle pin 44 projecting outwardly from enlarged boss 46 integrally formed on the inside wall surface.

From the foregoing it will be seen that the covers or heads 40 are freely pivotable about a pair of spaced apart horizontal axes which are at a level below the upper edges of the respective hollow bodies 34 and 36. Accordingly, when a cover is pivoted from a closed position as shown in FIG. 4, to an open position (the left-hand bodies 34 in FIGS. 1 and 3), the open spacing between the lower edges of a head or cover and the upper edge of the adjacent hollow body resembles the relatively large open mouth of a bullfrog. It should also be noted that the inwardly facing portions of the covers 40 are enlarged somewhat from a hemispherical shape in order to extend over the upper end of a hollow body and form a protruding upper lip. Thus, as the heads or covers 40 open and close with respect to the hollow bodies 34 and 36, the action closely resembles a pair of facing bullfrogs opening and closing their relatively large mouths.

In accordance with the present invention, each cover or head is provided with a downwardly extending, integral, concave, tongue 48 which serves as an ejector for propelling a lightweight ball 50 or other projectile, upwardly and outwardly of the open upper end of the hollow body in a direction toward the opposite hollow body. As illustrated in FIG. 3, when the lightweight ball 50 is contained within the hollow body 36 it is supported on the sloping tongue 48 against an inwardly facing wall segment of the body. As the cover 40 is pivoted to an open position, the ball is propelled upwardly and out of the open upper end of the hollow body in a direction towards the opposite hollow body 34. When the ball strikes the tongue 48 of the open cover 40, on the opposite body, the cover is biased to pivot downwardly to a closed position. Once a cover is moved from a closed position to an open position, it remains in an open position because of the weight distribution of the entire cover structure. The covers and ejector tongue structure are bistable and tend to remain either in an open or a closed position. With a cover in the open position as illustrated in FIGS. 1 and 3, the associated ejector tongue 48 slopes inwardly and downwardly at a lower slope angle than when the cover is closed. Accordingly, with the cover open, the tongue is readily adapted to receive a ball tossed over by the opposite frog. When a ball rolls down the tongue 48 of an open cover 40, the weight of the ball causes the cover to pivot to the closed position and the cover then remains in the closed position until the ball is outwardly ejected as described. After a ball is ejected, the cover remains in the open position until a ball is received or other pressure is applied to the tongue to close the cover.

In order to sequentially open the covers 40 of the opposite bodies 34 and 36 and thereby cause the tongues to eject the ball 50 back and forth, each body is provided with a vertically disposed ejector pin 52 which is rounded at opposite ends and is slidably supported in the bore of an integrally formed boss or projection 54 on the inside surface. Adjacent the upper end portion, each ejector pin is provided with a cross member or stop 52*a* for limiting the downward travel of the pin so that the rounded lower end is always spaced above the upper surface of the rotor disk 20 as shown in FIGS. 3 and 5. The rounded upper end of the pins are adapted to engage a curved undersurface 56 of a web-like cam follower segment 58 on the inside of each cover 40. When the pins 52 are lifted upwardly from the position shown in FIGS. 3 and 5, they cause the respective covers to pivot to the open position exposing the open upper end of the respective bodies 34 and 36. As illustrated, the web-like cam followers 58 also provide strengthening and integral support for the depending ejector tongues 48 extending downwardly from the roof of the convex covers 40.

In accordance with the invention, each time the rotor disk 20 completes one revolution, a spring-like cam element 60 secured to the upper surface of the rotor disk travels around a circular path coincident to the positions of the respective lift pins 52. The cam causes the pins to be momentarily lifted, thereby opening each of the associated covers 40 once during each revolution of the rotor. After the covers are opened, they remain stable in an open position until they are closed by the weight of a ball 50 on an ejector tongue 48 or other positive closing force. After the cam passes by an ejector pin, the pin then drops back down to a lower or rest position as shown in FIGS. 3 and 5 with its cross-member 52*a* seated on the upper surface of the supporting boss 54. The cam 60 may be constructed of thin metal to provide resilience when engaging the lower rounded ends of the ejector lift pins 52 and may be secured to the rotor disk by a rivet 62 or other fastener.

Figure 2:
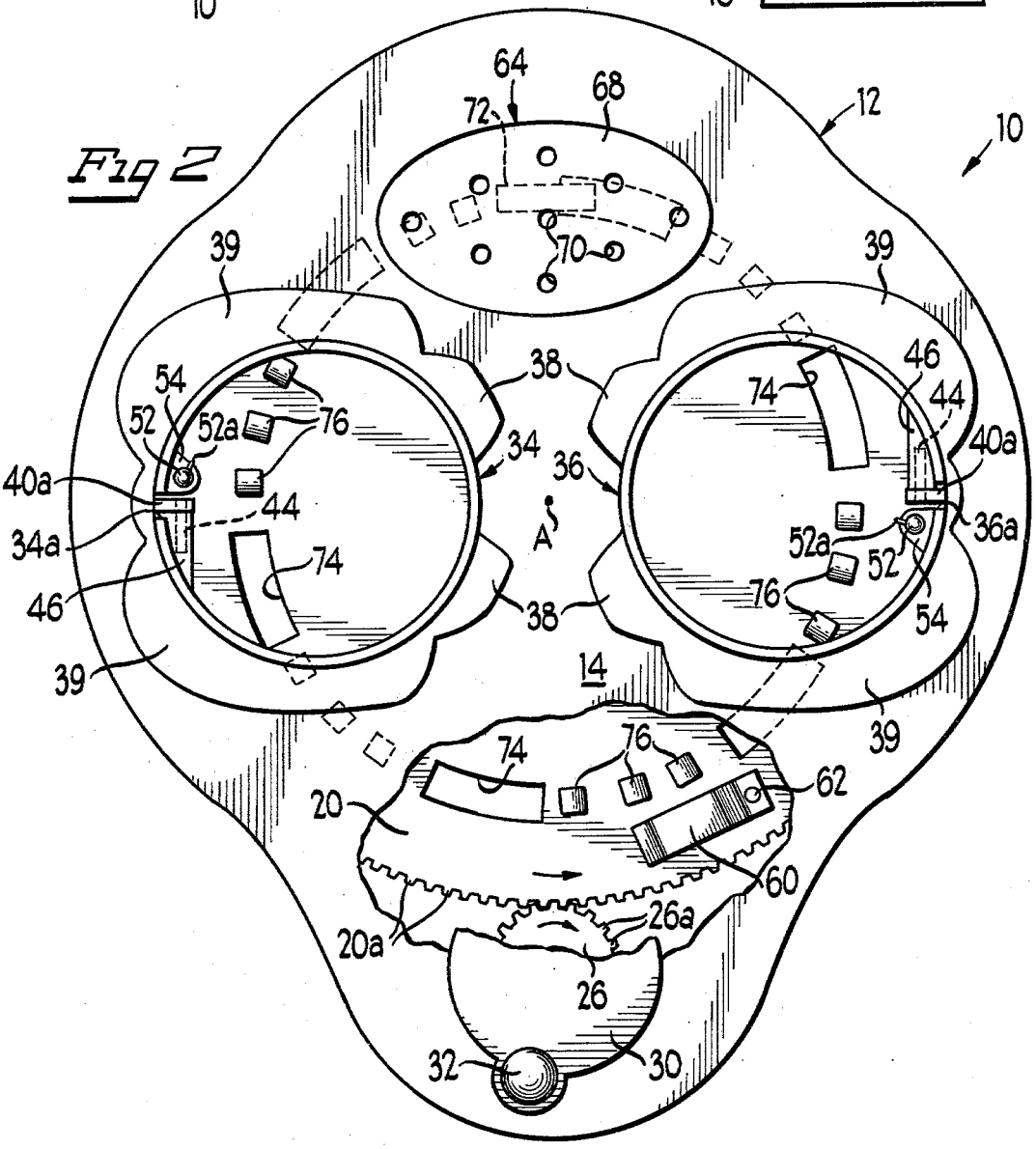
FIG. 2 is a top plan view of the apparatus with portions broken away and cover elements removed to show interior details.

In accordance with the present invention, the toy apparatus 10 also includes a sound generating device 64 spaced on a diametrically opposite side of the axis A—A from the crank disk 30 as shown in FIGS. 1 and 2. The sound generator includes a cup-shaped diaphragm 66 of fish paper or other suitable, thin flexible sheet material mounted in an upwardly extending, integrally formed, hollow, sound chamber 68 having a plurality of openings 70 in an upper wall thereof spaced above the vibrating diaphragm. A deflectable, depending, vibrating finger 72 is secured to the underside of the fish paper diaphragm and has a lower end portion extending downwardly far enough to resiliently engage in sequence a plurality of circumferentially, spaced apart lugs 76 arranged in a concentric ring on the upper surface of the rotor 20. An arcuate aperture 74 permits and provides room for the finger to vibrate. As illustrated in FIG. 2, the ring of lugs is tangent with the depending finger 72 attached to the diaphragm and preferably the lugs are integrally molded on the rotor. Upon rotation of the rotor, a continuing progression of lugs 76 engage the lower end of the reed or finger causing it to vibrate and in turn, vibrate the diaphragm 66 which generates a sound in the upper portion of the hollow chamber. This sound passes out through a plurality of ports or openings 70 in the upper wall of the sound chamber and the sound produced is similar to the sound of a croaking bullfrog. When the crank handle 32 is turned to drive the rotor 20 a croaking sound is developed and the ball 50 appears to be spit back and forth between the open and closing mount of the frog bodies 34 and 36. The more or less continuous din of croaking sounds developed by the sound generator 64 add to the realism of the toy apparatus.

From the foregoing, it will be seen that the new and improved toy apparatus 10 provides an interesting and exciting pastime for young children and is useful in developing motor skills. For example, if the crank is turned too fast, the ball 50 may be forcefully ejected over and above an opposite open cover 40 and if the crank is turned too slow, the ball may not even reach the tongue 48 in the opposite hollow body 34 or 36. In general, a proper speed of rotation of the crank 32 results in the ball being forcefully ejected by an ejector tongue 48 as the associated cover 40 is opened and the ball follows a trajectory towards the exposed tongue in the open upper end of the opposite body. If the ball strikes the undersurface of the open opposite cover, it tends to roll down the tongue until its weight causes the cover to pivot from an open to a closed position wherein the ball is positioned between the tongue and inside wall portion of the body ready to be ejected as the cam lug 60 passes through 180° of rotor movement. This process is reversed and repeated as the ball is spit back and forth between the respective bodies 34 and 36. During operation, the toy apparatus 10 appears to look like a pair of bullfrogs facing each other and spitting a ball back and forth as their mouths open and close with a frog-like croaking sound in the background.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A toy apparatus, comprising:

a base structure having a pair of spaced apart, upstanding hollow bodies mounted thereon, each of said hollow bodies having an open end for receiving and containing a projectile;

a movable cover pivotally mounted to close the open end of said body, said covers being movable to an open position to permit said projectile to pass into and out of said body;

a projectile ejector for each of said bodies for propelling a projectile out of said open top, through the air toward the open top of another body; and manually operable means interconnecting the projectile ejector for each body for sequentially actuating the projectile ejector in a timed sequence to propel said projectile back and forth therebetween.

2. The toy apparatus of claim 1 wherein said covers are mounted for bistable operation on said body between said open and closed position.

3. The toy apparatus of claim 2 wherein said projectile ejector of each body is activated by said projectile received in said open upper end to move said cover to said closed position.

4. The toy apparatus of claim 1 wherein said cover and ejector means on each body are integrally interconnected are are pivotally mounted for movement between said open and closed position.

5. The toy apparatus of claim 4 wherein each said cover is outwardly convex and said ejector means comprises a tongue extending downwardly from an inside surface of said cover when said cover is in said closed position.

6. The toy apparatus of claim 5 wherein each of said covers includes a pair of outwardly bulging eyes on the outer surface thereof, and said hollow bodies are generally cylindrical with feet like formations adjacent a lower level.

7. The toy apparatus of claim 1 wherein said manually operable means includes a rotor mounted for manual rotation on said base and a pair of actuator rods in each of said bodies engaged by said rotor to move a respective ejector means to propel said projectile out of said body.

8. The toy apparatus of claim 7 including a cam on said rotor for lifting said actuator rods to propel said projectile out of a body when said rotor is turned.

9. The toy apparatus of claim 8 including hand crank means on said base for turning said rotor.

10. The toy apparatus of claim 7 including sound generator means activated by turning of said rotor to generate sound.

11. The toy apparatus of claim 10 wherein said sound generator means includes a diaphragm and a resilient member for vibrating said diaphragm activated by turning of said rotor.

12. The toy apparatus of claim 11 wherein said base includes a sound chamber supporting said diaphragm therein and said rotor includes a plurality of lugs for moving said resilient member as said rotor turns.

13. The toy apparatus of claim 9 wherein said rotor includes a circular disk mounted for rotation adjacent a central axis of said base, said hollow bodies disposed on opposite sides of said axis and said hand crank means spaced radially outward of said axis between said bodies.

14. The toy apparatus of claim 13 including sound generator means including a diaphragm and sound chamber spaced on an opposite side from said hand crank means.

15. The toy apparatus of claim 14 wherein said manually operable means includes a cam on said disk for activating said projectile ejector of each body, each revolution of said disk, and said sound generator means includes a flexible member for vibrating said diaphragm and a ring of lugs on said disk adapter to move said flexible member to generate sound as said disk is turning.

16. An amusement device, comprising:

a base structure having a pair of spaced apart, upstanding hollow bodies mounted thereon, each of said hollow bodies having an open upper end for receiving and containing a projectile;

a movable cover portion pivotally mounted to close the open end of said bodies, said covers being movable to an open position to permit said projectile to pass into and out of said body;

a projectile ejector in each of said bodies for propelling a projectile out of said open top toward the open top of the other body;

means interconnecting said ejector means and cover of each body to move said cover to said open position in a timed sequence when the projectile is propelled outwardly toward said other body; and manually operable means for sequentially actuating the projectile of each body to propel said projectile back and forth therebetween.

17. The amusement device of claim 16 wherein said covers are generally in the form and shape of the head of a frog.

* * * * *